United States Patent [19]

Atkinson, III et al.

[11] Patent Number: 4,768,308

[45] Date of Patent: Sep. 6, 1988

[54] UNIVERSAL LENS POLISHING TOOL, POLISHING APPARATUS AND METHOD OF POLISHING

[75] Inventors: Leland G. Atkinson, III; Duncan T. Moore, both of Rochester, N.Y.

[73] Assignee: University of Rochester, Rochester, N.Y.

[21] Appl. No.: 942,880

[22] Filed: Dec. 17, 1986

[51] Int. Cl.[4] ..... B24B 7/00

[52] U.S. Cl. ..... 51/124 L; 51/165.71; 51/284 R

[58] Field of Search ..... 51/124 L, 165.71, 284 R, 51/33 W, 55

[56] References Cited

U.S. PATENT DOCUMENTS

| | | | |
|---|---|---|---|
| 3,492,764 | 2/1970 | Dalton | 51/124 L |
| 3,676,960 | 7/1972 | Aspden | 51/54 |
| 3,877,177 | 4/1975 | Taniguchi | 51/284 |
| 4,128,968 | 12/1978 | Jones | 51/54 |
| 4,557,075 | 12/1985 | Ullmann et al. | 51/165.71 |
| 4,590,573 | 5/1986 | Hahn | 51/165.71 |
| 4,612,736 | 9/1986 | Massard et al. | 51/165.71 |
| 4,653,233 | 3/1987 | Brueck | 51/124 L |

*Primary Examiner*—Frederick R. Schmidt
*Assistant Examiner*—Robert Showalter
*Attorney, Agent, or Firm*—Cumpston & Shaw

[57] ABSTRACT

A universal polishing tool comprises a rigid cup having a circular rim to which is attached a relatively thin resilient polishing pad. In accordance with a method for using the tool, the tool is rotated about the axis of a support shaft causing the resilient polishing pad to move with respect to the surface which is being polished. The universal polishing tool is dynamically positioned as a function of time with respect to the surface being polished. The orientation and position as a function of time are determined by a control algorithm according to the geometry of the tool and the particular surface being polished and are controlled by means of a controllable positioning device. In the case of a spherical surface or a rotationally symmetric aspheric surface, the lens is rotated about its axis of symmetry during the polishing operation. In the case of a toric surface, the lens is oscillated about an axis which is normal to its center.

37 Claims, 12 Drawing Sheets

CALCULATION

Calculate tool position for extreme edge contact.

Store the tool position.

Select the number of tool positions that will be used to cover the entire lens surface.

Select the number of annuluses into which the lens surface is divided for the computation of relative wear.

CYCLE1:

Determine the pressure distribution as a function of lens coordinate for this tool position.

Determine the relative velocity distribution as a function of lens coordinate for this tool position.

Calculate the relative wear function for in each of the annuluses covering the entire lens surface.

Store the accumulated relative wear values for each annulus.

IF last tool position has not been reached THEN GOTO CYCLE1.

Deconvolve the relative wear to yield a time pressure product for each tool position.

Store the time pressure products.

FABRICATION

Position the tool over the first position.

CYCLE2:

Measure the force between tool and lens.

Hold the tool at the position until the force-time product is equal to the stored value.

Move to next tool position.

IF last tool position has not been reached THEN GOTO CYCLE2.

FABRICATION COMPLETE

Universal Polishing Algorithm Flow Diagram.

CALCULATION

Calculate tool position for extreme edge contact.

Store the tool position.

Select the number of tool positions that will be used to cover the entire lens surface.

Select the number of annuluses into which the lens surface is divided for the computation of relative wear.

CYCLE1:

Determine the pressure distribution as a function of lens coordinate for this tool position.

Determine the relative velocity distribution as a function of lens coordinate for this tool position.

Calculate the relative wear function for in each of the annuluses covering the entire lens surface.

Store the accumulated relative wear values for each annulus.

IF last tool position has not been reached THEN GOTO CYCLE1.

Deconvolve the relative wear to yield a time pressure product for each tool position.

Store the time pressure products.

FABRICATION

Position the tool over the first position.

CYCLE2:

Measure the force between tool and lens.

Hold the tool at the position until the force-time product is equal to the stored value.

Move to next tool position.

IF last tool position has not been reached THEN GOTO CYCLE2.

FABRICATION COMPLETE

Figure 10 Universal Polishing Algorithm Flow Diagram.

UNIVERSAL LENS POLISHING TOOL, POLISHING APPARATUS AND METHOD OF POLISHING

This invention relates generally to methods and apparatus for polishing lenses and more particularly to a universal lens polishing tool having a deformable polishing surface, a high speed, automatic lens polishing machine using said tool, and a method of polishing lenses.

The methods and apparatus of this invention may be used in the fabrication of spherical, rotationally symmetric aspheric, and toric lenses and mirrors, as well as tools having such surfaces which are used to manufacture such elements, such as mold cavities, and other articles having optically smooth surfaces. For convenience, articles and tools having optical surfaces of whatever nature are included within the scope of the term lens as used herein.

Presently, because their cost of manufacture is too high, aspheric surfaces are not being used in a large number of applications that would benefit from their use. A substantial portion of the cost of manufacturing lenses is the cost of polishing the surface.

Lens making includes grinding and polishing steps. The grinding process uses fast cutting abrasives such as diamond particles to remove large amounts of material from the lens. Abrasive grinding proceeds quickly, and automatic grinding machines are available that can produce spherical surfaces quickly with little if any operator attention. Accordingly, spherical lenses can be ground at relatively low cost. Apparatus for grinding aspheric lenses is either considerably more expensive or requires manual operation and in either case the cost of grinding aspheric lenses is greater than the cost of grinding spherical lenses. Nevertheless, the most significant portion of the cost of manufacturing aspheric lenses is the cost of polishing. This invention provides improved methods and apparatus for polishing aspheric as well as spherical lenses.

We can define three different classes of polishing tools by polishing tool size. These are small area tools, ring tools and full surface tools. A small area tool usually has a diameter which is less than 10% of the diameter of the lens surface and therefore an area of about 1% or less of the surface area of the lens. A ring tool ordinarily contacts a few to 50% of the lens at one time and a full surface polisher is considered to be one that contacts more than about 80% of the lens surface at one time.

Because of its small size in relation to the lens surface the pressure distribution under a small area polisher is nearly constant and the relative wear is simply proportional to the time the polisher spends over a point on the surface.

Full surface polishers are at least as large as the lens surface and are shaped to match the shape of the surface of the lens to be polished. When used to polish spherical surfaces the full surface polisher matches the lens through large relative motions of the polisher to the lens, therefore a uniform pressure and relative wear over the surface of the lens can be easily achieved. When full surface polishers are used to polish aspheric lens surfaces even a small relative motion between the polisher and the lens surface causes a mismatch between the polisher and the surface and leads to large pressure variations which can not be compensated without rebuilding or reshaping the polishing tool. The need to rebuild or reshape the polisher may occur many times during the polishing process. Full surface polishers are therefore restricted to small relative motions.

Ring tools generally and ring tool polishers in particular have a diameter which is comparable to or larger than the radius of the lens and contact the lens surface over an area which is much larger than that for a small area tool. For both spherical and aspheric lens surfaces the contact region normally extends from the center to the edge of the surface of the lens. During a full rotation of the lens contact may occur over the entire lens surface. When lenses are polished with a ring tool polisher a large variation in pressure and relative wear under the polisher occurs and known ring tool polishing processes, that is random polisher movement for a relatively long time, cannot be used because unacceptable surface irregularities are produced.

Full surface polishing tools are preshaped to match the desired final surface and can be used to modify the shape of the ground surface only slightly, for example to change a spherical surface to a slightly aspheric surface. Greater changes are not practical because the time required to remove any substantial amount of material from a lens with a polishing tool would be extremely long. Accordingly, a different full surface rigid polishing tool is needed for each spherical and non-spherical surface to be polished.

Small area rigid polishing tools contact only a small area of the lens at a time and can be used to polish a more general class of surfaces including sphericl and aspheric surfaces. Conventionally, small area rigid polishing tools include a polishing layer or pad such as a pitch, felt, polytron, or pellon pad attached to a rigid surface. A polishing abrasive is mixed with a carrier such as water to form a slurry that is applied to the pad. The rigidly backed pad distributes the polishing slurry over the work surface at a substantially uniform pressure. A polisher using such a tool is described in U.S. Pat. No. 4,128,968. With the tool shown in this patent and all other rigid polishing tools heretofore known, an essential characteristic is that the tool contact the lens at a constant pressure over the surface of the tool. A disadvantage of this type of small area rigid polishing tool is that the pad must be very small compared to the size of the surface being polished in order to maintain constant pressure between the pad and the lens over the pad surface. As long as a constant force is maintained on the small area rigid tool as it is moved over the surface, it is relatively easy to define a path for the pad that produces uniform polishing. In U.S. Pat. No. 4,128,968 an automated padd drive mechanism is described that moves a pair of small area rigid tools along a predetermined path while maintaining pad contact with the surface being polished.

It is a disadvantage of small area rigid polishing tools generally and of the apparatus described in the U.S. Pat. No. 4,128,968 in particular that the polishing process is very slow. Because the pad diameter is limited to no more than ten percent of the diameter of the surface being polished the process is slow even for small surfaces.

Rigid polishers which are very small compared to the dimensions of the work surface can be used with computer control algorithms to modify the shape of a surface slightly. A method for doing so is described in U.S. Pat. No. 3,676,960. The disadvantage of this method is that a very long polishing time is required since only a small region of the surface can be polished at one time.

Spherical lenses can be polished relatively quickly and inexpensively with full surface and other rigid polishing tools that are moved randomly over the surface. Because rigid polishing tools inherently remove material from the lens at the same rate over the entire surface of the tool, their behavior is relatively easy to characterize and they are easy to control. Random motion of such tools inherently produces a spherical surface.

While full surface rigid polishing tools that are shaped to the desired final surface can be utilized to polish aspheric lenses, such tools are expensive and a different tool is needed for each lens. Frequent rebuilding or reshaping of the polishing tool during polishing is necessary and also increases the cost of the polishing process. A large inventory of tools is required and therefore the use of full surface rigid polishing tools for polishing aspheric lenses is inconvenient and expensive for many applications including ophthalmic applications where a large number of different lenses must be manufactured to the requirements of individual prescriptions.

Flexible polishing tools are made from elastically deformable materials such as rubber, polyurethane, or an hydraulically or air supported flexible membrane. Flexible polishers deform to the shape of the lens and therefore tend to polish without changing the shape of the ground surface. This is desirable for surfaces that are ground to the correct final shape but cannot be used to modify the ground shape, to add an aspheric component to a spherical lens for instance. Flexible polishing tools have a nonuniform pressure distribution over the surface of the tool with a relatively high pressure in the center and a pressure of zero at the edge of the tool.

In principal, an hydraulically supported membrane tool would overcome this difficulty, but heretofore, hydraulically supported polishing tools have been limited to very low pressures and speeds due to membrane support problems. This leads to very long polishing times.

Spherical surfaces can be polished with a flexible polishing tool by moving the tool randomly over the surface for a relatively long time. This process removes a substantially constant amount of material from the entire surface of the lens but is limited to polishing spherical lenses. Heretofore, it has been impossible to polish aspheric surfaces with flexible tools without changing their shape significantly during the polishing process. Aspheric surfaces polished by random movement of a large area flexible polishing tool tend to become more spherical. This is the advantage of such tools in polishing spherical surfaces, but is also their major disadvantage for more general polishing. For surfaces which do not depart very much from a spherical surface flexible polishers have been used successfully even when the pressure distribution has been ignored as described for example by B. C. Willard, Appl. Opt. 19, pg 488, 1980.

Gih-Horng Chen has described a large area resilient polishing tool the produces close to a uniform pressure distribution over the surface of the tool. Chen's tool was a ring tool having a groove in the end carrying a thick resilient polyurethane ring shaped to match the surface of the lens being polished. The ring was supported on the sides as well as the bottom and produced a near uniform pressure due to its close match to the shape of the lens surface. The polishing surface of the ring was shaped to match the required aspheric surface and the base of the ring was flat giving it a nonuniform thickness. For aspheric surfaces of the type considered by Chen, the shape of the ring surface was the complement of the base sphere of the aspheric surface. While Chen was successful in obtaining high speed polishing, a deep central hole was produced in the lens, destroying its usefulness for many applications. Chen correctly attributed this effect to the nonuniform polishing distribution of the ring polishing tool, and suggested that better results could be obtained by obtaining a more uniform polishing distribution.

Heretofore, it has been impossible to combine the speed of large area rigid polishing tools with the versatility of small area rigid polishing tools to polish aspheric lenses. No method had been known to use large area deformable polishing tools to successfully polish nonspherical lenses at high speed.

It is an object of this invention to provide a universal polishing tool which can be used to polish a wide range of spherical and aspheric surface shapes and eliminate the need for a special polishing tool for each surface shape to be fabricated.

It is another object of this invention to provide a method of using such a universal polishing tool to accurately polish spherical surfaces and to shorten the polishing time over that required with small area polishing tools.

It is yet another object of this invention to provide a method of using such a universal polishing tool to accurately polish rotationally symmetric aspheric surfaces and to shorten the polishing time over that required with small area rigid polishing tools.

It is a further object of this invention to provide a method of using such a universal polishing tool to accurately polish toric surfaces and to shorten the time over that required with small area rigid polishing tools.

It is a still further object of this invention to provide a high speed automatic grinding and polishing machine that can be used to produce spherical, rotationally symmetric aspheric, and toric lenses.

Briefly stated and in accordance with one aspect of this invention a universal polishing tool comprises a rigid cup having a rigid circular rim to which is attached a resilient polishing pad. The rigid cup is carried by a support shaft having an axis of rotation that passes through the center of the circular rim and is normal to the plane of the rim. The circular rim may have a variety of cross section shapes. The polishing pad is relatively thin and and has a constant thickness and produces a nonuniform pressure on the lens. In the case where the cross sectional shape of the rim of the tool is circular, the pressure is greatest in the center of the pad and lower at the boundaries of the contact area. In use, the universal polishing tool is rotated about the axis of the support shaft causing the resilient polishing pad to move with respect to the surface which is being polished. The universal polishing tool is dynamically positioned as a function of time with respect to the surface being polished. The orientation as a function of time is determined by a control algorithm according to the particular surface being polished and is controlled by means of a controllable positioning device. In the case of a spherical surface or a rotationally symmetric aspheric surface, the lens is rotated about its axis of symmetry during the polishing operation. In the case of a toric surface, the lens is oscillated about an axis which is normal to its center.

In accordance with another aspect of the invention, a high speed automatic polishing machine is provided having a lens supporting pedestal adapted for rotation and oscillation of a lens to be polished. A deformable polishing tool is mounted in a rotating chuck adapted for moving the tool over the surface of the lens. Force sensor means are connected to the chuck to continuously measure the total tool-lens force. Control means are responsive to the force sensor means and to a control algorithm to move the tool over the surface of the lens to achieve the desired polish over the surface of the lens.

In accordance with a further embodiment of this invention, the relative wear function as a function of universal polishing tool position is calculated. The relative wear function is then deconvolved from the desired wear function to determine the tool positions and force-time products which will be used in the fabrication process. Preferably the tool position as a function of time is then calculated and stored for later use in the fabrication process based on a constant force, but in some cases a force that varies with the position of the tool on the lens surface is desirable. During the fabrication process the actual force is measured and the calculated tool position as a function of time is modified accordingly using the stored force-time products.

In accordance with still another aspect of this invention, a method of polishing a spherical, rotationally symmetric aspheric or toric lens is provided comprising the steps of providing a deformable circular polishing tool, rotating the tool about its axis, contacting he surface of the lens with the tool, measuring the force between the tool and the lens, continuously calculating the amount of material removed by the tool for each annulus on the lens, and adjusting the tool position as a function of time according to the stored force-time products to achieve the desired polish.

The foregoing and other objects, features and advantages of the invention, as well as the presently preferred embodiments thereof and the best mode now known for practicing the invetion, will become more apparent from reading of the following description in connection with the accompanying drawings in which.

Figure 5:
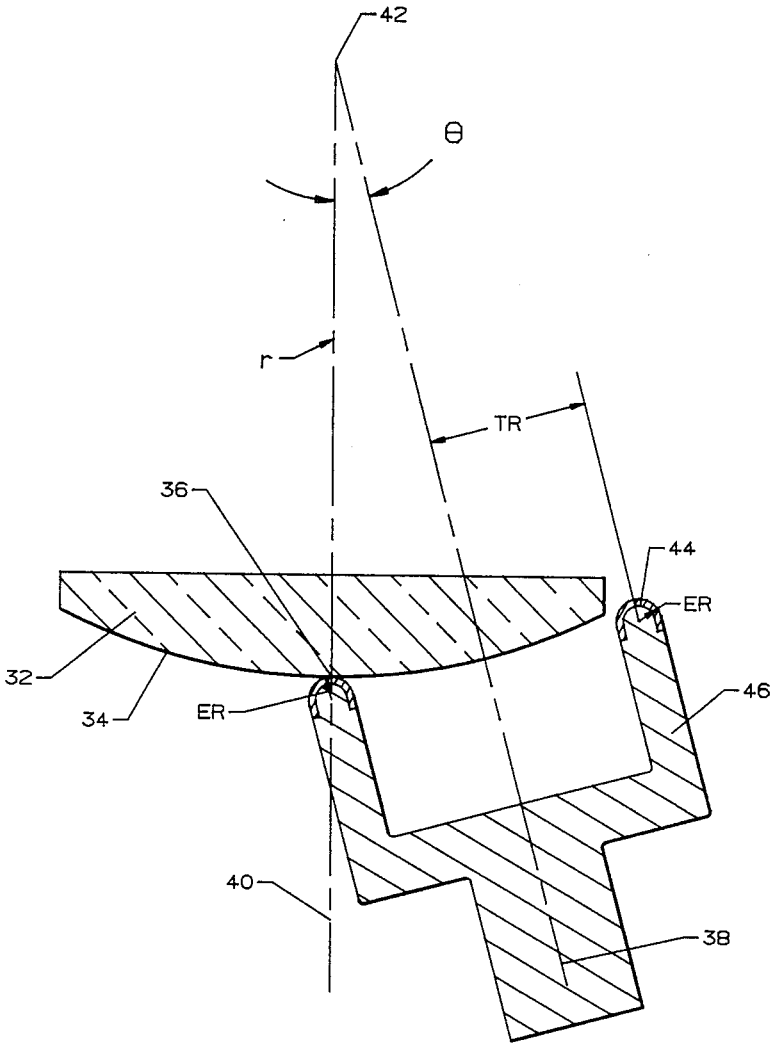
FIG. 5 is a cross-sectional view of the universal polishing tool shown in FIG. 1 together with a spherical surface showing a particular orientation of the universal polishing tool with respect to the spherical surface.
Figure 9:
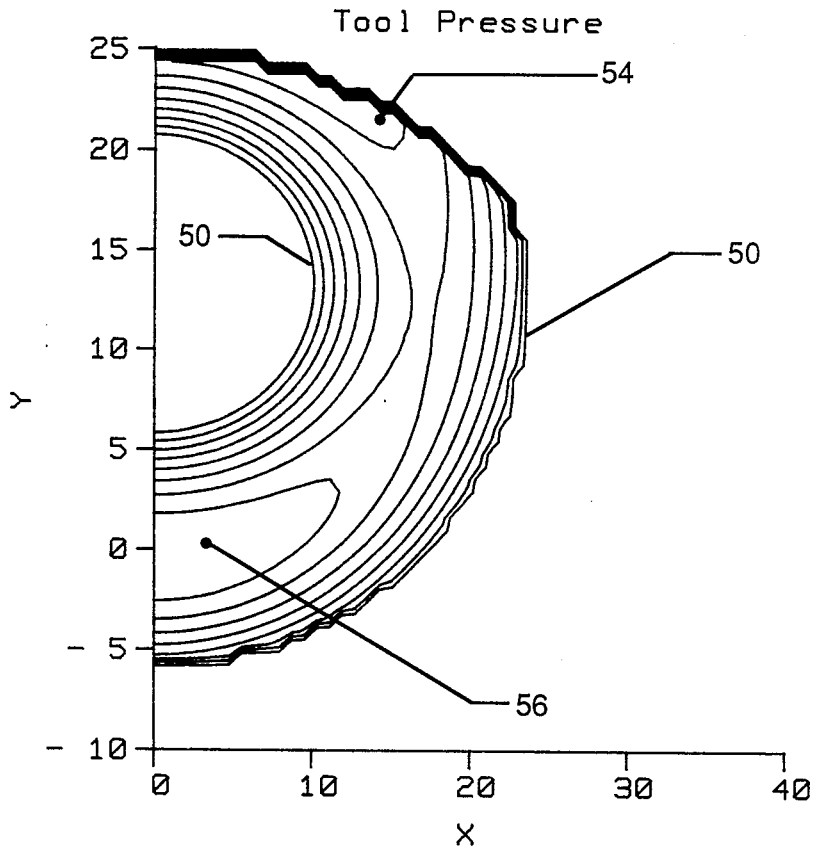

FIG. 9 is an exemplary contour plot of the pressure in the contact region projected onto the plane of the circular rim of the universal polishing tool which would result if the surface shown in FIG. 5 were an aspheric surface. In this example the surface is a parabola with a diameter of 50.0 mm. The tool has an edge radius of 6.0 mm and a diameter of 26.0 mm.

FIG. 10 is a process flow diagram of the control algorithm used to direct the positioning of a universal polishing tool in accordance with this invention.

Figure 11B:
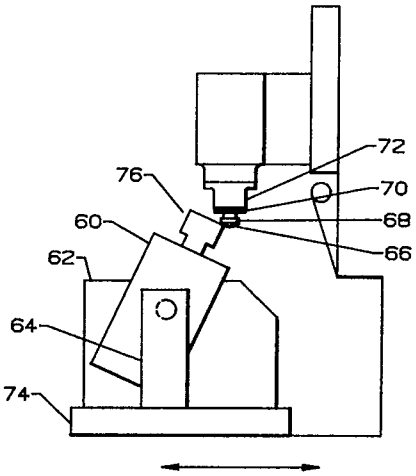
Figure 11A:
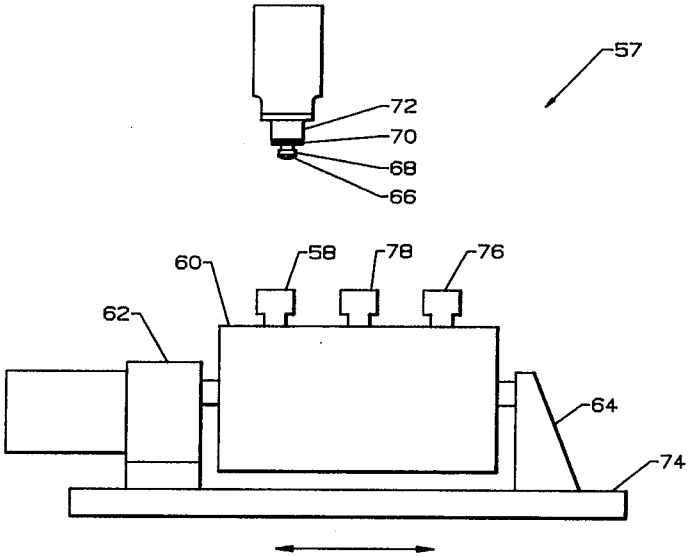

FIGS. 11A and 11B are diagrammatic views of a positioning system in accordance with this invention implemented using a commercial CNC milling machine or machining center.

Figure 12B:
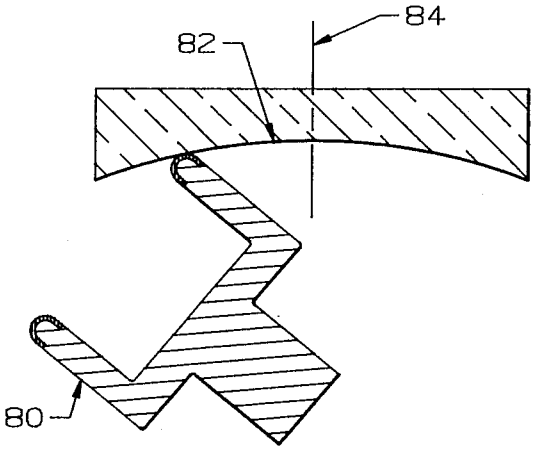
Figure 12A:
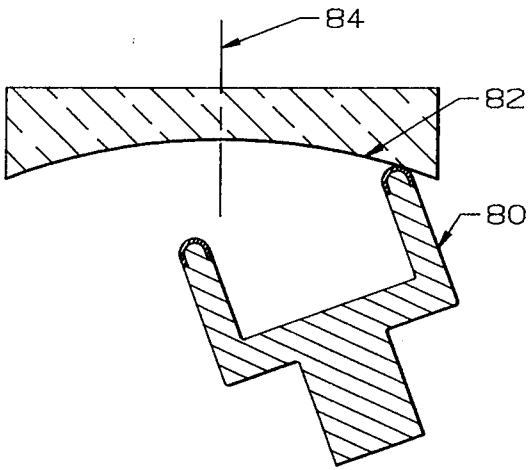

FIGS. 12A and 12B are diagrammatic views of a universal polishing tool in accordance with this invention oriented with respect to a toric surface while polishing two different portions of the toric surface.

Figure 1:
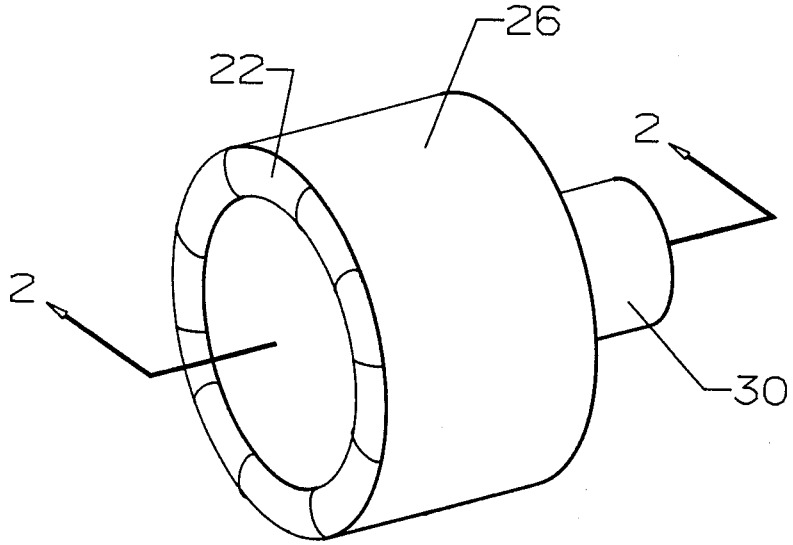
FIG. 1 is a perspective view of a universal polishing tool in accordance with a presently preferred embodiment of this invention.
Figure 2:
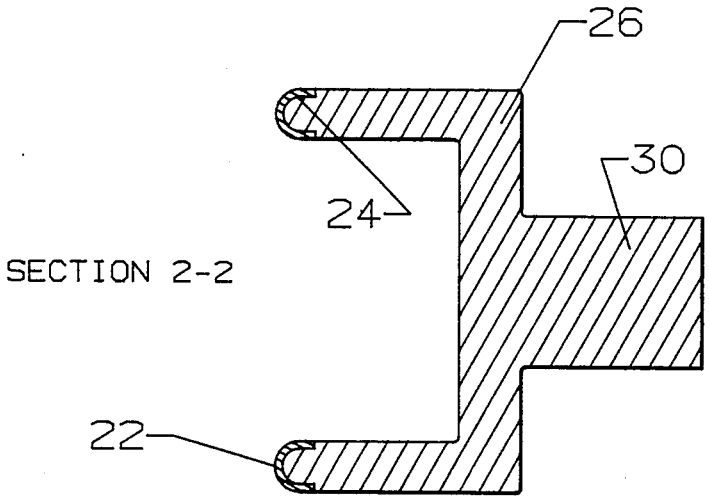
FIG. 2 is a cross-sectional view of the universal polishing tool taken along line 2—2 of FIG. 1.

A universal polishing tool in accordance with a presently preferred embodiment of this invention is shown in FIGS. 1 and 2. The polishing tool shown in FIG. 1 is adapted for polishing all types of surfaces including concave and convex spherical, rotationally symmetric aspheric and toric surfaces. A layer of resilient deformable plastic material, such as a polyurethane pad 22, is attached to a circular rim 24 on one end of a generally cylindrical rigid cup 26. Preferably, pad 22 has a constant thickness and rim 24 is milled to a circular cross-section having a radius slightly smaller than the desired radius of the tool. Circular cross-sections are preferred because they are relatively simple to manufacture and because the calculation of pressure distribution between the pad and the lens can be made easily. The other end of cup 26 includes a shaft 30 or other means of mounting the universal polishing tool so that it may be rotated about an axis which passes through the center of the circular rim and is normal to the plane of the circular rim.

Preferably, pad 22 has a thickness of about 0.125 inches (3.175 mm). The thickness of the pad should be no greater than that necessary to provide a deformable polishing surface. As the pad becomes thicker the dynamics of the polisher deformation and polisher material uniformity become increasingly significant and more difficult to predict and the calculation of the pressure distribution between the pad and the lens becomes more complex. This is especially true near the edge of the lens where an uncontrollable rounding of the edge results when a thick pad is used. The actual thickness of the deformable polishing surface depends upon the elasticity of the deformable surface and the hardness of the lens surface. Preferably, when using polyurethane to polish crown glass, the deformable surface should be of a thickness such that the ratio of maximum deformation to pad thickness of the polisher surface at the desired total polishing force is about 1:10. This value has been determined experimentally and may vary significantly depending upon the exact nature of the deformable polishing material and other polishing conditions.

Figure 3:
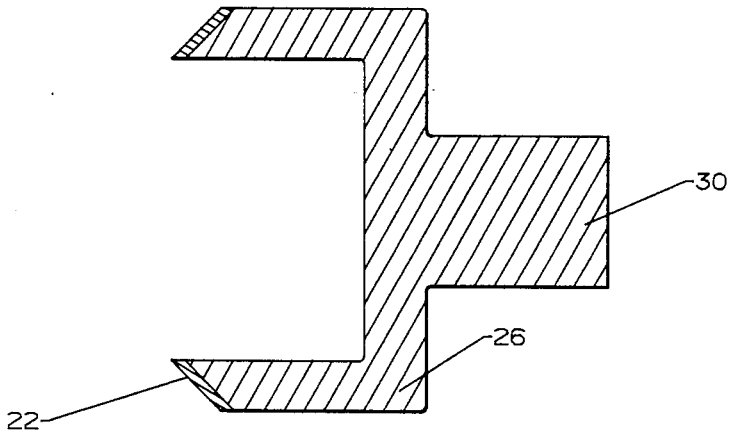
FIG. 3 is a cross-sectional view of a universal polishing tool particularly designed for polishing convex surfaces.
Figure 4:
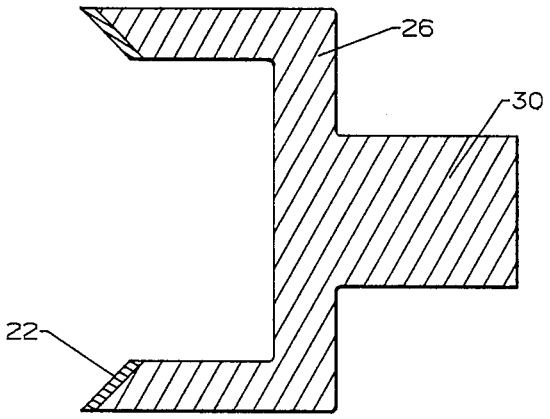
FIG. 4 is a cross-sectional view of a universal polishing tool particularly designed for polishing concave surfaces.

FIGS. 3 and 4 are cross-sectional views of alternative embodiments of a universal polishing tool in accordance with this invention. The polishing tool shown in FIG. 3 has a cup 26 having a relatively flat end surface that is inclined away from the center of cup 26 and a flat conical polishing pad 22. The polishing tool shown in FIG. 3 is particularly designed for polishing concave surfaces. The polishing tool illustrated in FIG. 4 has a relatively flat end surface inclined toward the center of cup 26 and a flat conical polishing pad 22 and is particularly designed for polishing convex surfaces.

In all of the embodiments of the universal polishing tool of FIGS. 1–4, the polishing pad is attached to the end of the cup by conventional means such as a layer of adhesive, not shown.

FIG. 5 is a cross-sectional view of the universal polishing tool 22 of FIG. 1 and a lens 32 during a polishing process in accordance with this invention. The lens includes a surface 34 which is to be polished. The universal polishing tool contacts the lens surface in a region around point 36. Preferably, in the case of rotationally symmetric surfaces, the lens is continuously rotated about its axis at a constant angular velocity during the polishing process. For toric surfaces it is preferable to oscillate the lens around its central axis. The axis of rotation of the universal polishing tool 38 intersects the axis of rotation of the lens 40 at the center of curvature 42 of the lens surace 34. The distance between the centerline of the center of the circular rim 44 and the universal polishng tool axis 38 is the tool radius, TR. For the spherical surface 34 shown in FIG. 5, the radius r, of the surface 34 is given by the following equation:

$$r = \frac{TR - ER \cdot \text{SIN}\,\theta}{\text{SIN}\,\theta}$$

where $\theta$ is the angle between the axes of rotation of the tool and lens, 38 and 40 respectively and ER is the radius of the edge of the universal polisher.

Figure 6:
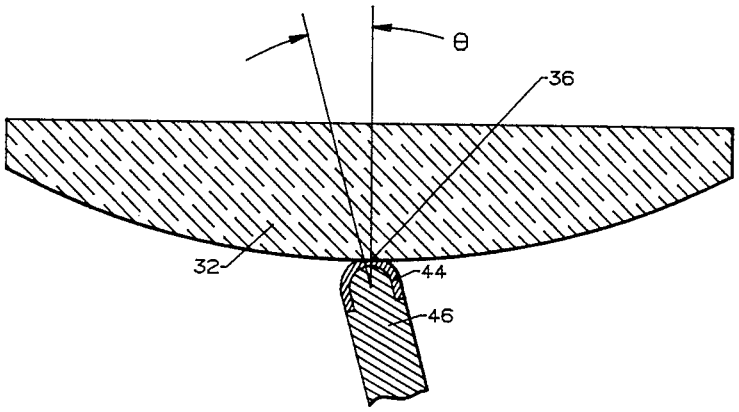
FIG. 6 is an enlarged view of the cross-sectional view of the contact region between the universal polishing tool and the spherical surface of FIG. 5 showing the deformation of the resilient polishing surface due to the contact force.
Figure 7:
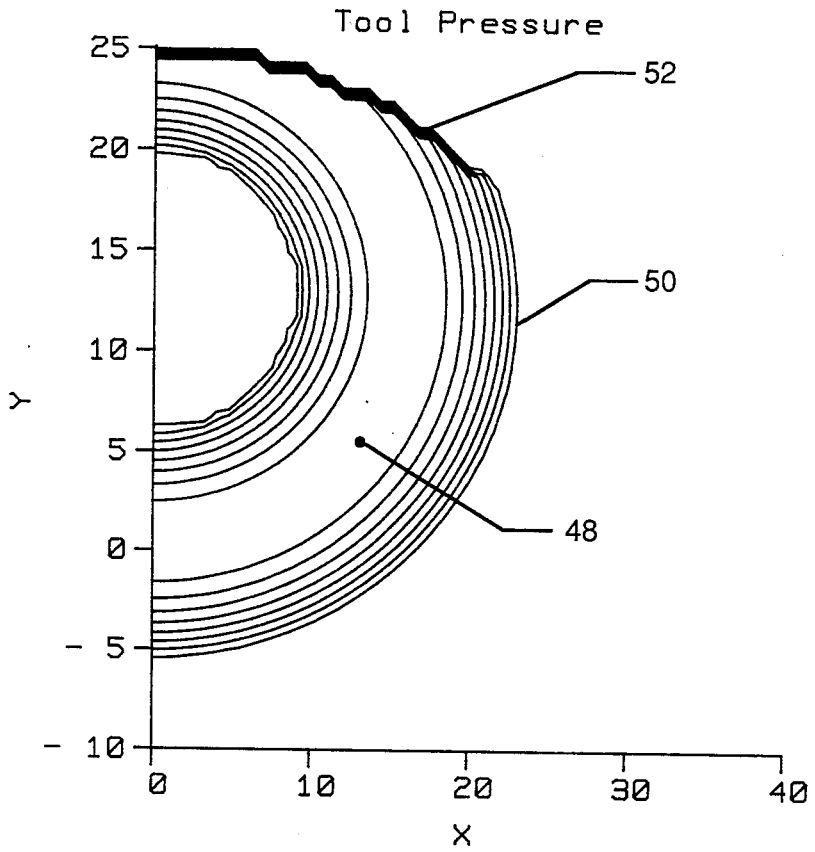
FIG. 7 is a contour plot of the pressure in the contact region projected onto the plane of the circular rim of the universal polishing tool which results from the contact shown in FIGS. 5 and 6.

An enlarged cross-sectional view of the contact region 36 between the resilient polishing pad and the lens 32 is shown in FIG. 6. Although the polishing pad deforms at the contact region, the rigid cup 46 and its rim 44 do not deform and a varying pressure distribution exists in the contact region. FIG. 7 shows the pressure distribution as determined by solving the classical Hertzian Contact problem. The highest pressure exists in the center of the contact region 48 and the pressure decreases to zero at the edge of the polishing tool contact region 50 or at the edge of the lens 52.

Figure 8:
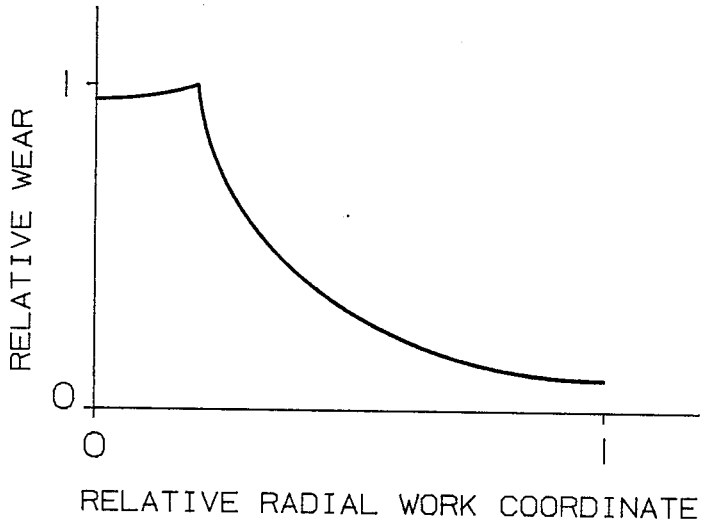
FIG. 8 is a graph of the relative wear as a function of surface radius produced by a universal polishing tool oriented as shown in FIGS. 5 and 6.

The relative wear in an annular region of the lens surface is directly proportional to the product of the pressure and the relative velocity between the polishing tool and the lens surface integrated over the contact time per rotation of the lens surface. The resulting relative wear function for the universal polishing tool and a spherical lens in the orientation shown in FIG. 1, whose pressure distribution is shown in FIG. 7, is shown in FIG. 8. The pressure distribution which results if the surface in FIG. 5 is aspheric instead of spherical is shown in FIG. 9. There are two regions 54 and 56 of local maximum pressure within the contact region. The pressure decreases to zero at the edges 50 of the contact region and at the edge of the lens.

The algorithm used to control the universal polishing tool during the polishing is shown in the process flow diagram of FIG. 10. The algorithm is slightly different depending upon whether or not a rotationally symmetric or non-symmetric lens surface is being polished. The algorithm used for rotationally symmetric lens surfaces is described first. Modifications to the algorithms necessary to polish nonrotationally symmetric lens surfaces will then be described. The principal difference between the two algorithms is whether or not the lens surface is rotated about it symmetry axis or oscillated a small amount about an axis through a point near its geometric center and the coordinate system in which the equations are written is changed from polar to rectangular.

The polishing process of this invention includes two steps, the calculation step and the fabrication step. In accordance with a presently preferred embodiment of the invention, all of the calculations necessary to polish a particular lens with a particular tool are carried out prior to beginning the fabrication step. In some circumstances, it may be desirable to combine the calculation and fabrication steps, or to alternately perform calculations and portions of the fabrication.

The calculation begins by finding the required tool position for the first step of the universal polishing tool. This is accomplished by calculating the tool position which would result in a theoretical nondeformable tool of the same shape as the deformable polisher contacting the lens surface or its mathematical extension at two points at the ends of a diameter of the theoretical tool. A position of the polisher on its axis that produces the desired total polishing force is then calculated. This contact condition will be referred to herein as extreme edge contact. In the special case where the lens surface has a sperical shape, the two regions of contact degenerate into a single annular region. Initially, the position of the universal polishing tool in which one of the regions of contact is centered about the lens' rotation axis is used as the starting position for the remainder of the calculations. The number of tool positions that will be used in the fabrication step is selected. The lens is then divided into a selected number of annular regions from the center to the edge. Preferably number of annular regions is selected so that the desired lens surface is well described, but there must be at least as many annular regions as discrete tool positions selected for the fabrication step.

The number of steps required to polish a lens will vary with the size of the lens relative to the width of the polishing tool and the required accuracy of the polishing step. As few as three steps can produce acceptable results in some cases where the surface is nearly spherical and the width of the polishing contact region is large and more than 20 steps are almost never required or even beneficial. Five to ten steps usually provide acceptable quality and reasonable polishing times.

The relative wear as a function of lens coordinate, hereinafter referred to as the relative wear function, is then calculated from Preston's Law using the relative velocity distribution, $V(r,\phi)$, the pressure distribution, $P(r,\phi)$, and the elasticity of the universal polishing tool. Preston's Law is an empirical formula which is often used to describe wear and abrasion processes. One form of Preston's Law can be stated as follows:

$$h(r) = \int_{\phi_0}^{\phi} P(r,\phi) \cdot V(r,\phi) \cdot C \cdot d\phi$$

where, h is the relative wear function which describes the amount of material removed from the lens surface during one cycle of the lens from $\phi_0$ to $\phi$, $P(r,\phi)$ is the pressure distribution between the polisher and the lens surface and $V(r,\phi)$ is the relative velocity distribution between the polisher and lens surface and C is a constant dependent upon the lens material and the polishing conditions.

The calculation of the relative wear function is repeated for each position of the universal polishing tool. At each position, a new extreme edge contact orientation for the universal polishing tool is determined and the relative wear function for the new position calculated. At each position of the tool the relative wear functions for each annulus on the lens are stored for later deconvolution. This procedure is repeated until the entire lens surface has been covered which usually occurs when the inner most edge of the polisher has reached, or is near, the lens edge.

A force-time product for each position of the tool is now calculated for each annulus on the surface of the lens such that the total material removal during polishing for each annulus, with radial coordinate r, on the lens surface is the desired value. As can be seen from FIG. 8, the relative wear rate is greatest at the center of the contact region nearest the lens vertex. Once the desired amount of material removal in this region has been obtained, the position of the universal polishing tool is incremented radially outward on the lens surface with the original contact conditions maintained. A force-time product is calculated for each position of the polishing tool to achieve the desired polishing value and then the process repeated for the next step until the force-time product has been calculated for the entire surface.

To perform the calculations to obtain the required force-time products used in determining the time for each polishing step a deconvolution process is used. The wear function w(r) can be described as a convolution of the relative wear function h(r) with the respective force-time product D(ξ):

$$w(r) = \int_{O}^{R} h(r - \xi) \cdot D(\xi) \cdot d\xi.$$

The most common polishing objective is to have the wear function, w, be equal to a constant value for all values of r, the radial lens coordinate. However other functions of w may be desired to correct a surface to something other than the shape of the lens surface initially presented to the universal polishing tool. The wear function thus determined is referred to herein as the desired wear function.

The convolution equation previously stated assumes a continuous motion of the universal polishing tool across the lens surface. Preferably, as heretofore described, the continuous motion is approximated by a number of discrete steps. In the case of discrete steps, the convolution equation is evaluated by replacing the integral with a sum over the discrete position values for the relative wear $$w(r) = \sum_{\xi=0}^{R} h(r - \xi) \cdot D(\xi).$$

The force-time product for each universal polishing tool position is computed by the deconvolution of the discrete convolution. This can be done in several ways using a digital computer. The presently preferred method is to take the Fourier transform of the desired wear function and the relative wear fuction and then apply the convolution theorem. The convolution theorem states that the convolution of two functions is equivalent to the multiplication of their Fourier transforms, under certain conditions which these functions meet. Deconvolution is then be performed by division of the proper Fourier transforms and then inverse Fourier transforming the result. To calculate the force-time product, the Fourier transform of the desired wear function is divided by the Fourier transform of the relative wear function, and the inverse Fourier transform of the quotient is taken.

A nonrotationally symmetric (cylindrical or toric) lens can also be polished using the universal polishing tool as shown in FIGS. 12A and 12B. Here the universal polisher 80 is oriented at an angle to the cylindrical surface 82 such that the universal tool fits the surface along the most steeply curved cylindrical axis, also known as the cross curve. The fit is not exact as described in U.S. Pat. No. 4,574,527 however the same algorithm as used above can be used to position the tool such that a uniform polish can be obtained. The polisher is then moved along the more gently curved cylindrical axis, known as the base curve, while maintaining the fit of the universal tool to the cross curve. During the polishing process the cylindrical surface is oscillated about an axis 84 which passes through the approximate geometric center of the lens surface. Preferably the oscillations range in magnitude from approximately plus or minus 1 degree to plus or minus 10 degrees or even greater if the surface is near spherical. Frequencies for the oscillation are not critical since they are used only to average the irregularities in the polyurethane material. Convenient oscillation frequencies are on the order of a few cycles per second. The equations for material removal during polishing and convolution must be rewritten in terms of Cartesian coordinates instead of radial coordinates since rotational symmetry is no longer present, but otherwise they are unchanged. Preferably the polishing process is initiated with the polisher at one extreme edge of the cylindrical surface and moved across the base surface with the positions and force-time products stored during the calculation phase of the process.

The fabrication portion of the algorithm is now performed using the force-time and position values computed during the calculation phase. A lens surface which has been prepared by grinding, turning, molding, or the like to the desired surface shape, or nearly the desired surface shape, is supported such that it can be rotated about its symmetry axis, or in the case of nonrotationally symmetric surfaces, about the central axis. The universal polishing tool is brought into contact with the lens using the position values stored during the calculation phase. For each position of the polisher, the force between the polishing tool and the lens is monitored and adjusted, through motion of the universal polishing tool along its axis, to maintain the desired value. Polishing proceeds until all of the stored positions have been maintained for the calculated dwell times. A process flow diagram of the universal polisher control algorithm is shown in FIG. 10.

FIG. 11 is a diagrammatic elevational view of apparatus for manufacturing lenses in accordance with this invention. A milling machine such as a commercial Boston Digital BostoMatic 312 CNC milling machine or machining center is employed. The universal polishing tool 58 is mounted in a spindle support box 60 which is supported between a rotary axis 62 and a tailstock assembly 64, both of which are mounted to the bed of the BostoMatic 312 milling machine. The lens 66 is mounted to a blocking device 68 with a suitable adhesive, such as wax, or held in place by a vacuum. Blocking device 68 is attached to a tool holder 70 which is in turn inserted in the milling machine's spindle 72. The required X and Y motions are provided by the motion of the bed of the milling machine 74 and the required Z motion is provided by the motion of the mill spindle 72. The angular positioning is provided by the rotary axis. During the polishing operation, a polishing slurry, such as cerium oxide, aluminum oxide or other suitable material, is directed into the polishing tool either by flooding the center of the tool from above or a central coolant feed through the universal polishing spindle mounting shaft.

During the polishing operation, a control computer, such as a Data General Eclipse S/140, sends commands to the mill to properly orient the universal polishing tool 58 with respect to the lens 66. The total force applied by the universal polishing tool to the work piece is measured by monitoring the current to the polishing spindle and reading the value into the control computer. While the polishing cycle is in progress, the Z axis of the mill's position is adjusted by the control computer to provide the desired force between the work piece surface and the universal polishing tool as determined by the polishing algorithm.

In addition to the ring tool polisher of this invention, ring tool grinding cups 76 and 78 have been incorporated into the system so that all of the fabrication operations of generating, fine grinding, and polishing can be performed under computer control on a single machine without operator intervention. A liquid coolant such as water soluble oil, synthetic oil, or other suitable coolant is directed into the grinding cups in a manner similar to that of the polishing tool.

The Optical CAM fabrication system, using the universal polishing tool, is capable fo polishing spherical surfaces to surface accuracies of better than two rings of power and one quarter ring of irregularity, as measured with a standard test glass and using a green mercury light source.

An example of a particular lens which has been fabricated using the universal polishing tool is a spherical surface with a radius of curvature of 50 mm and a diameter of 25 mm. The tool had a diameter of 30 mm, a shape as shown in FIG. 4 and a polyurethane pad ⅛" thick. The tool was rotated at about 900 RPM and the lens was rotated at about 2000 RPM. The surface was processed on the BostoMatic 312 with the modifications shown in FIG. 11. The polishing proceeded using 5 steps with times of 35, 40, 35, 20, and 15 seconds respectively for a total polishing time of about 2.5 minutes. The force was held at a constant value of 1000 units during the entire polishing cycle. The resulting surface had a peak to valley surface error of 0.65 wavelengths of light at a wavelength of 0.633 nm. This compares very favorably with optical surfaces used in photographic equipment where surface irregularities of 1 to 3 wavelengths are common. This example does not represent the ultimate accuracy of a surface which can be produced by this technique.

While the invention has been described in connection with certain presently preferred embodiments thereof, certain modifications and changes will be apparent to those skilled in the art. Accordingly, the true spirit and scope of the invention is intended to be defined solely by the appended claims.

What is claimed is:

1. Lens polishing apparatus comprising:

means for holding a lens;

a polishing tool;

positioning means for moving the polishing tool relative to the lens, and rotating the tool;

sensor means for measuring the force between the tool and the lens; and control means connected to the sensor means and the positioning means for calculating a force-time product for each area of the lens to be polished and supplying signals to the positioning means so that the force-time product for each area equals a desired force-time product to produce the desired relative material removal from each area of the lens surface to remove a desired amount of material from each area of the lens.

2. The apparatus of claim 1 wherein the lens holding means comprises means for oscillating the lens about an axis normal to the surface of the lens and passing approximately through the geometrical center of the lens.

3. The apparatus of claim 1 wherein the lens holding means comprises means for rotating the lens.

4. The apparatus of claim 1 wherein the polishing tool comprises a ring shaped tool having a rigid polishing surface.

5. The apparatus of claim 4 wherein the ring shaped tool comprises a cup shaped tool having a resilient polishing pad characterized by a substantially constant thickness, attached to the polishing surface.

6. The apparatus of claim 5 wherein the resilient polishing pad comprises a layer of deformable elastic material.

7. The apparatus of claim 6 wherein the layer of deformable elastic material comprises a layer of polyurethane foam.

8. The apparatus of claim 4 wherein the polishing surface is characterized by a generally circular cross section.

9. The apparatus of claim 4 wherein the polishing surface is a substantially flat annulus.

10. The apparatus of claim 4 wherein the polishing surface is a segment of a conical surface.

11. The apparatus of claim 4 wherein the polishing surface comprises a convex surface.

12. The apparatus of claim 4 wherein the polishing surface comprises a concave surface.

13. A method for polishing a lens comprising:

providing a lens to be polished;

providing a deformable polishing tool;

calculating a force-time product for the deforamable polishing tool as a function of the position of the tool for a plurality of discrete positions of the tool on the lens to produce a desired degree of polish on the lens;

rotating the tool;

contacting the lens with the tool;

measuring the force between the lens and the tool;

moving the tool among the plurality of positions; and holding the tool at each position until the product of the measured force and the time the tool is held in the position equals the calculated force-time product for such position.

14. The method of claim 13 wherein calculating the force-time product comprises:

determining the pressure distribution as a function of tool position on the lens;

determining the relative velocity distribution as a function of tool position on the lens;

calculating the wear function over the surface of the lens; and deconvolving the wear function.

15. The method of claim 14 wherein calculaing the wear function, w(r), comprises:

determining the relative wear function as a function of tool position on the lens; and summing the products of the relative wear function, h(r), multiplied by the force-time product, D, for a plurality of discrete positions of the tool on the lens according to the formula $$w(r) = \sum_{\xi=0}^{R} h(r-\xi)\cdot D(\xi).$$

16. The method of claim 15 wherein determining the relative wear function, h(r), as a function of tool position on the lens comprises solving the equation $$h(r) = \int_{\phi_0}^{\phi} P(r,\phi)\cdot V(r,\phi)\cdot C\cdot d\phi$$

for each position of the tool.

17. The method of claim 14 wherein calculating the force-time product comprises deconvolving the wear function.

18. The method of claim 17 wherein deconvolving the wear function comprises:

dividing the Fourier transforms of the desired wear function, w, by the Fourier transform of the relative wear function, h; and taking the inverse Fourier transform of the quotient.

19. A method for polishing a lens with a ring tool polisher comprising:

determining the pressure distribution as a function of tool position on the lens;

determining the relative velocity distribution as a function of tool position on the lens;

calculating the wear function over the surface of the lens;

calculating the force-time product for each position of the polisher with respect to the lens to produce the desired degree of polish on the lens;

bringing the tool into contact with the lens;

measuring the force between the tool and the lens;

moving the tool relative to the lens so that the product of the time and force at each position of the tool is equal to the calculated force-time product.

20. The method of claim 19 further comprising calculating a relative wear function as a function of tool position on the lens according to the equation $$h(r) = \int_{\phi_0}^{\phi} P(r,\phi)\cdot V(r,\phi)\cdot C\cdot d\phi$$

21. The method of claim 19 wherein calculating the wear function comprises calculating the convolution of the relative wear function with the force-time product function over the surface of the lens according to the equation $$w(r) = \int_{O}^{R} h(r-\xi)\cdot D(\xi)\cdot d\xi$$

where w(r) is the wear function;

h is the relative wear function as a function of universal tool position; and

D is the force-time product as a function of position.

22. The method of claim 21 wherein calculating the force-time product comprises deconvolving the wear function.

23. The method of claim 22 wherein deconvolving the wear function comprises:

dividing the Fourier transform of the desired wear function, w, by the Fourier transform of the relative wear function, h; and taking the inverse Fourier transform of the quotient.

24. The method of claim 20 wherein calculating the wear function comprises summing the relative wear functions for a plurality of discrete positions of the tool on the lens according to the formula $$w(r) = \sum_{\xi=0}^{R} h(r-\xi)\cdot D(\xi).$$

25. The method of claim 24 wherein calculating the force-time product comprises deconvolving the wear function.

26. The method of claim 25 wherein deconvolving the wear function comprises:

dividing the discrete Fourier transform of the desired wear function, w, by the discrete Fourier transform of the relative wear function, h; and taking the discrete inverse Fourier transform of the quotient.

27. Apparatus for polishing a lens comprising:

lens holding means;

a polishing tool;

sensor means for measuring the force between the tool and the lens to be polished;

means for storing a plurality of predetermined force-time products for a plurality of positions of the tool with respect to the lens;

positioning means for moving the polishing tool relative to the surface of the lens to be polished;

control means connected to the sensor means and the positioning means for supplying signals to the positioning means to move the polishing tool relative to the lens surface so that the product of the measured force and the time the tool contacts the lens at each of the positions equals the stored force-time product for such position.

28. The apparatus of claim 27 wherein the polishing tool comprises a ring shaped tool having a rigid polishing surface and a resilient polishing pad characterized by a substantially constant thickness, attached to the polishing surface.

29. The apparatus of claim 36 wherein the resilient polishing pad comprises a layer of deformable elastic material.

30. The apparatus of claim 29 wherein the layer of deformable elastic material comrpises a layer of polyurethane foam.

31. The apparatus of claim 28 wherein the polishing surface is characterized by a generally circular cross section.

32. The apparatus of claim 28 wherein the polishing surface is a substantially flat annulus.

33. The apparatus of claim 28 wheren the polishing surface is a segment of a conical surface.

34. The apparatus of claim 28 wherein the polishing surface comprises a convex surface.

35. The apparatus of claim 28 wherein the polishing surface comprises a concave surface.

36. The apparatus of claim 27 wherein said lens holding means comprises means for rotating the lens.

37. The apparatus of claim 27 wherein the lens holding means comprises means for oscillating the lens about an axis normal to the surface of the lens and passing approximately through geometric center of the lens.

* * * * *